US011330926B1

(12) United States Patent
Root

(10) Patent No.: US 11,330,926 B1
(45) Date of Patent: May 17, 2022

(54) SELECTIVELY SECURABLE CONTAINER APPARATUS AND METHOD

(71) Applicant: Jon K. Root, Pensacola, FL (US)

(72) Inventor: Jon K. Root, Pensacola, FL (US)

( * ) Notice: Subject to any disclaimer, the term of this patent is extended or adjusted under 35 U.S.C. 154(b) by 0 days.

(21) Appl. No.: 16/830,381

(22) Filed: Mar. 26, 2020

Related U.S. Application Data

(60) Provisional application No. 62/823,721, filed on Mar. 26, 2019.

(51) Int. Cl.
*A47G 29/20* (2006.01)

(52) U.S. Cl.
CPC ..... *A47G 29/20* (2013.01)

(58) Field of Classification Search
CPC ..... A47G 29/20; A47G 29/14; A47G 29/16; A47G 29/141; A47G 29/18; A47G 29/22; A47G 29/24; A47G 29/1209; A47G 29/124; A47G 2029/144; A47G 2029/148
USPC ..... 232/17, 19, 22, 39, 45
See application file for complete search history.

(56) References Cited

U.S. PATENT DOCUMENTS 1,847,969 A * 3/1932 Marks ..... A47G 29/20 232/42
5,624,071 A * 4/1997 Sosan ..... E05B 67/003 232/29
6,155,715 A * 12/2000 Lake ..... A47G 29/20 150/102
6,375,070 B1 * 4/2002 Snoke ..... A47G 29/141 232/20
9,873,549 B2 * 1/2018 Heinz ..... A47G 29/141
10,143,321 B2 * 12/2018 Hippert ..... A47G 29/20
10,292,519 B1 * 5/2019 Sutton ..... A47G 29/1209
10,383,471 B1 * 8/2019 Barnes ..... A47G 29/20
10,512,352 B1 * 12/2019 Torres ..... A47G 29/22
10,537,197 B2 * 1/2020 Hopp ..... A47G 29/20
10,682,002 B2 * 6/2020 Miller ..... A47G 29/20
10,932,602 B2 * 3/2021 Hauck ..... A47G 29/12095
10,993,567 B1 * 5/2021 Cabral-McKeand ..... A47G 29/141
11,026,531 B2 * 6/2021 Campodonico ..... A47G 29/20
11,064,831 B1 * 7/2021 Biddle ..... A47G 29/22
11,172,777 B1 * 11/2021 Ausland ..... A47G 29/141
2016/0051073 A1 * 2/2016 Heinz ..... A47G 29/141 232/39
2016/0068306 A1 * 3/2016 Heinz ..... B65D 81/02 220/560.01
2016/0309939 A1 * 10/2016 Mencel ..... A47G 29/20
2017/0188737 A1 * 7/2017 Hippert ..... A47G 29/20
2018/0070753 A1 * 3/2018 Eveloff ..... H04W 4/025
2018/0202199 A1 * 7/2018 Critz ..... E05B 73/0005
2018/0296016 A1 * 10/2018 Teoh ..... A47G 29/20
2019/0231104 A1 * 8/2019 Dunkelberger ..... E05B 73/00

(Continued)

*Primary Examiner* — William L Miller
(74) *Attorney, Agent, or Firm* — J. Nevin Shaffer, Jr.

(57) ABSTRACT

A selectively securable container apparatus and method consists of a container with a lid where the container is sealed from opening when the lid is in a closed and locked position. A hook with a first size and an extension with a first end and a second end and a length, where the length has a second size and where the second size of the length is smaller than the first size of the hook, where the first end is connected with the container and the second end is connected with the hook and where the smaller second size of the length of the extension fits between a space between the bottom of a first object and the top of a second object but the first size of the hook is larger than the space.

19 Claims, 2 Drawing Sheets

(56) References Cited

U.S. PATENT DOCUMENTS

| | | | | |
|---|---|---|---|---|
| 2019/0256119 | A1* | 8/2019 | Brilhante | A47G 29/124 |
| 2019/0350398 | A1* | 11/2019 | Raphael | A47G 29/141 |
| 2020/0060460 | A1* | 2/2020 | Farrar | A47G 29/141 |
| 2020/0107663 | A1* | 4/2020 | Eivaz | A47G 29/141 |
| 2020/0323377 | A1* | 10/2020 | O'Connor | A47G 29/20 |

* cited by examiner

SELECTIVELY SECURABLE CONTAINER APPARATUS AND METHOD

CROSS REFERENCE TO RELATED APPLICATION

This application claims the benefit of previously filed U.S. provisional patent application No. 61/823,721 filed Mar. 26, 2019 for a "Selectively Securable Container Apparatus and Method". The Applicant hereby claims the benefit of this provisional application under 35 U.S.C. § 119. The entire content of this provisional application is incorporated herein by this reference.

FIELD OF THE DISCLOSURE

The present invention pertains to a selectively securable container apparatus and method consisting of a container with a lid where the container is sealed from opening when the lid is in a closed and locked position. A hook with a first size and an extension are provided. The extension has a first end and a second end and a length, where the length has a second size and where the second size of the length is smaller than the first size of the hook, where the first end is connected with the container and the second end is connected with the hook and where the smaller second size of the length of the extension fits between a space between the bottom of a first object and the top of a second object but the first size of the hook is larger than the space.

BACKGROUND OF THE INVENTION

Modern ways of shopping have changed dramatically. Instead of going to a store and bringing the package home, currently more and more stores are delivering the packages to the home. This convenience ensures the practice will continue, however it does raise significant security issues and, in particular, the issue of packages being stolen off of porches ("porch piracy"). This problem has become a very common occurrence, with ample coverage on both the news and Internet.

One solution would be for the homeowner to permanently secure a "lock box" to his or her home. However, due to homeowner association restrictions lock boxes cannot be permanently mounted to front porches. The case may also be the same for certain condominiums and apartments per complex regulations. Further, such a permanent addition to a home is likely to be bothersome over time and not aesthetically pleasing.

Thus, there is a need in the art for an apparatus and method that addresses the aforementioned problems in a manner that is robust and flexible so as to accommodate a full spectrum of residences and package shapes and dimensions.

It therefore is an object of this invention to provide an improved selectively securable container apparatus and method for ensuring against porch piracy that is easy to use and economical to install and operate.

SUMMARY

Accordingly, a selectively securable container apparatus and method consisting of a container with a lid where the container is sealed from opening when the lid is in a closed and locked position. A hook with a first size and an extension are provided. The extension has a first end and a second end and a length, where the length has a second size and where the second size of the length is smaller than the first size of the hook, where the first end is connected with the container and the second end is connected with the hook and where the smaller second size of the length of the extension fits between a space between the bottom of a first object and the top of a second object but the first size of the hook is larger than the space.

In one aspect, the first object is a door and the second object is a doorjamb.

In another aspect, the invention further includes a bracket connected with the container where the first end of the extension is connected with the bracket such that the first end is movable along the bracket.

In a further aspect, there is more than one extension and, in one aspect, there are two extensions, with the first ends of the two extensions connected with the container, and one hook where the one hook is connected to the second ends of both extensions.

In one aspect, the hook extends from and perpendicular to the second end of the extension such that the hook engages the second object.

In another aspect, the invention further includes a lock where the lock is removably connectable with the lid and container.

In one aspect, the invention further includes a portal through which items are introduced to the container and where the portal blocks items within the container from being removed.

In a further aspect, the extension is metal flat stock material and the hook is angle steel.

According to another embodiment, a selectively securable container apparatus consists of a container with a lid where the container is sealed from opening when the lid is in a closed and locked position. A hook with a first size. An extension with a first end and a second end and a length, where the length has a second size and where the second size of the length is smaller than the first size of the hook, where the first end is connected with the container and the second end is connected with the hook such that when the length of the extension is placed between a bottom of a door and a doorjamb, such that the hook is on one side of the door and the first end of the extension is on the other side of the door when the door is in a closed position with the bottom of the door over the top of the doorjamb, removal of the smaller second size length of the extension is prevented by the larger first size of the hook.

In one aspect, the invention further includes a bracket connected with the container where the first end of the extension is connected with the bracket such that the first end is movable along the bracket.

In a further aspect, there is more than one extension and, in one aspect, there are two extensions, with the first ends of the two extensions connected with the container, and one hook where the one hook is connected to the second ends of both extensions.

In one aspect, the hook extends from and perpendicular to the second end of the extension such that the hook engages the doorjamb.

In another aspect, the invention further includes a lock where the lock is removably connectable with the lid and container.

In one aspect, the invention further includes a portal through which items are introduced to the container and where the portal blocks items within the container from being removed.

In a further aspect, the extension is metal flat stock material and the hook is angle steel.

According to another embodiment, a selectively securable container method consists of:

a. providing a container with a lid where the container is sealed from opening when the lid is in a closed and locked position; a hook with a first size; an extension with a first end and a second end and a length, where the length has a second size and where the second size of the length is smaller than the first size of the hook, where the first end is connected with the container and the second end is connected with the hook such that when the length of the extension is placed between a bottom of a door and a doorjamb, such that the hook is on one side of the door and the first end of the extension is on the other side of the door when the door is in a closed position with the bottom of the door over the top of the doorjamb, removal of the smaller second size length of the extension is prevented by the larger first size of the hook; and b. placing the length of the extension over a doorjamb.

In one aspect there is more than one extension and, in another aspect. there are two extensions, with the first ends of the two extensions connected with the container, and one hook where the one hook is connected to the second ends of both extensions.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF EMBODIMENTS

Figure 1:
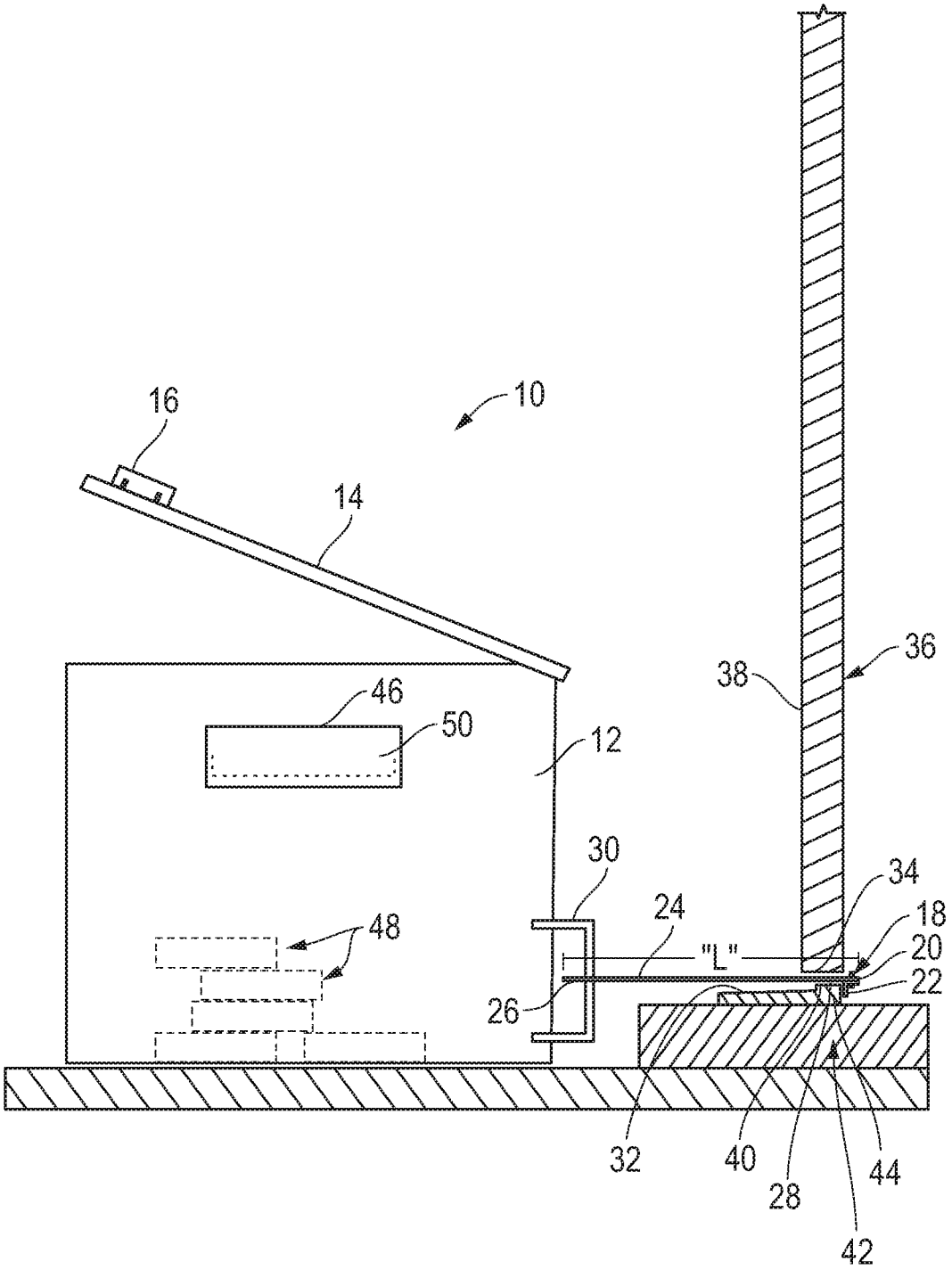
FIG. 1 is a side view of the selectively securable container apparatus including the container, lid, lock, extension, bracket, and hook in place behind a door.

Before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including equivalent constructions to those described herein insofar as they do not depart from the spirit and scope of the present invention.

For example, the specific sequence of the described process may be altered so that certain processes are conducted in parallel or independent, with other processes, to the extent that the processes are not dependent upon each other. Thus, the specific order of steps described herein is not to be considered implying a specific sequence of steps to perform the process. In alternative embodiments, one or more process steps may be implemented by a user assisted process and/or manually. Other alterations or modifications of the above processes are also contemplated. For example, further insubstantial approximations of the process and/or algorithms are also considered within the scope of the processes described herein.

In addition, features illustrated or described as part of one embodiment can be used on other embodiments to yield a still further embodiment. Additionally, certain features may be interchanged with similar devices or features not mentioned yet which perform the same or similar functions. It is therefore intended that such modifications and variations are included within the totality of the present invention.

It should also be noted that a plurality of hardware and software based devices, as well as a plurality of different structural components, may be utilized to implement the invention. Furthermore, and as described in subsequent paragraphs, the specific configurations illustrated in the drawings are intended to exemplify embodiments of the invention and that other alternative configurations are possible.

One embodiment of the present invention is illustrated by way of example in FIGS. 1-5. Referring to FIG. 1, selectively securable container apparatus and method 10 consists of a container 12 with a lid where the container 12 is sealed from opening when the lid 14 is in a closed and locked position. The locking of lid 14 to container 12 is preferably by means of a combination lock 16, as are known and not described more fully hereafter, yet lock 16 may be any locking device now known or hereafter developed suitable for the purposes of the invention.

A hook 18 with a first size is shown. Preferably, hook 18 is constructed of angle steel with one leg 20 and another leg 22 as will be described more fully hereafter.

Extension 24 has a first end 26 and a second end 28 and a length "L", where the length "L" has a second size and where the second size of the length "L" is smaller than the first size of the hook 18. As used herein the terms "first size" and "second size" are used in their common manner to describe objects with different dimensions, length, width, height, and, as here, one size is bigger than the other as illustrated in the Figures. Preferably, extension 24 is constructed of metal, such as aluminum, flat stock (bar). Thus, the hook 18 can be seen to be one size, one height, where extension 24 has another size, another height, as shown in FIG. 1. Extension 24 is preferably a flat material with a small height and hook 24 extends above the height of extension 24 so that, in that sense, when comparing one to the other, the first size of hook 18 is larger than the second size of length "L" of extension 24. Certainly, extension 24 does not have to be "flat", it could be a wire, round or otherwise, and still serve the same function for the invention so long as it is smaller than the hook 18.

Still referring to FIG. 1, the first end 26 of extension 24 is connected with the container 12. Preferably, first end 26 is connected with container 12 with a bracket 30 and bracket 30 is connected with the container 12. By this structure, when the first end 26 of the extension 24 is connected with the bracket 30, the first end 26 is movable up and down the bracket 30. This allows the invention to accommodate elevation differences between the container and the threshold, for example only. Certainly, first end 26 of extension 24 can be connected directly to container 12 if deemed more useful to the user's requirements.

The second end 28 of extension 24 is connected with the hook 18. FIG. 1 illustrates that the structure of the present invention, where the smaller second size of the length "L"

of the extension 24 fits between a space 32 between the bottom 34 of a first object 36, such as a door 38 by way of example only and not by limitation, and the top 40 of a second object 42, such as a doorjamb (threshold) 44, but the first size of the hook 18 is larger than the space 32. As a result, once the door 28, for example, is shut, hook 18 prevents extension 24 from being removed and extension 24 secures container 12 in place. It should be clear that the present invention works the same when the extension 24 is sandwiched between two objects, 36 and 38, that meet together in any other manner than top to bottom, such as side to side, for example only.

In one aspect, hook 18 is formed at an angle, as illustrated, such that one leg 20 extends from, parallel to, the second end 28 of extension 24 and the other leg 22 extends perpendicular to the second end 28 of the extension 24 such that the hook 18 engages with or catches on the second object 42 upon which it rests. That is, the downward facing leg 22 catches on the door jamb 44 as shown and further prevents removal of extension 24 from under the door and, thus, removal of container 12 and its contents.

Still referring to FIG. 1, in one aspect selectively securable container apparatus and method includes a portal 46 through which items 48 are introduced to the container 12. Portal 46 is an opening in container 12 big enough to allow items to be introduced to container 12 but not easily removed. That is, portal 46 may be too small for a person to reach into container 12 or may include a protective device such as a flap 50 as are found in postal boxes or in any manner such that the portal 46 blocks items 48 within the container 12 from being removed. Certainly, any combination of combination locks 16 and portals 46, or other means for providing controlled access to the contents within container 12 is acceptable.

Figure 2:
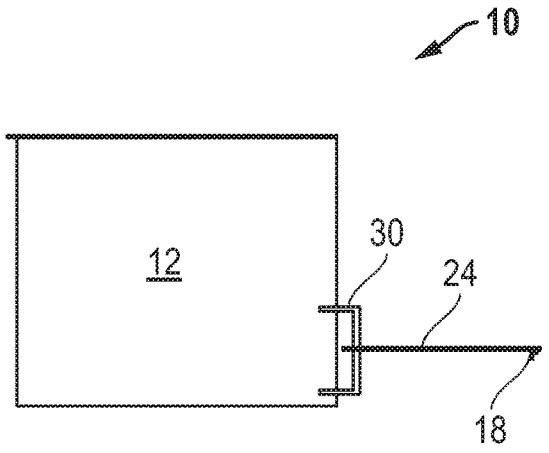
FIG. 2 is a side view of the invention of FIG. 1.
Figure 3:
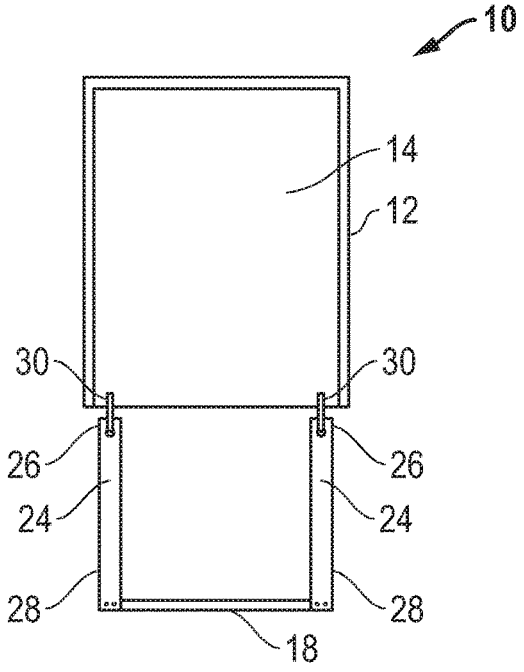
FIG. 3 is a top view of the invention of FIG. 1 showing more than one extension and hook combination connected with the container.
Figure 4:
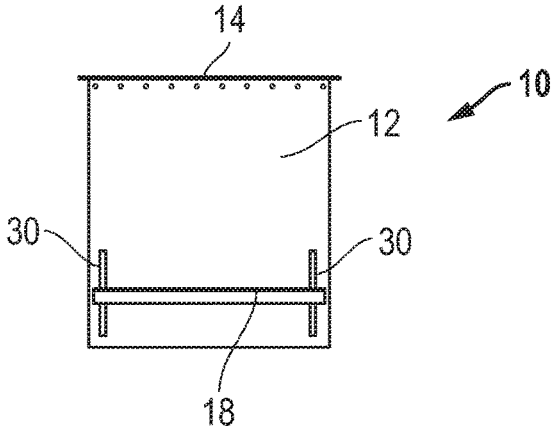
FIG. 4 is a back view of the invention of FIG. 1.
Figure 5:
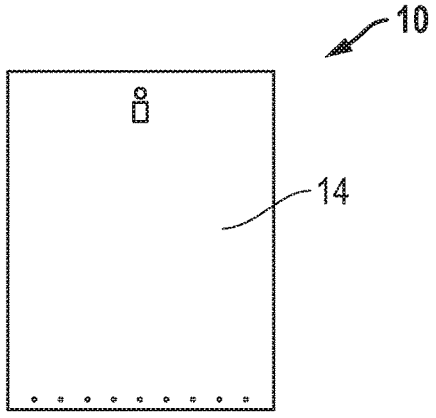
FIG. 5 is a top view of the lid of the invention of FIG. 1.

FIG. 2, is a side view of the invention of FIG. 1 and all the identifying numbers used in FIG. 1 are carried over to FIGS. 2-5. FIGS. 3 and 4 illustrate another aspect of the invention where there is more than one extension 24 and, in a preferred aspect, there are two extensions 24 with the first ends 26 of the two extensions 24 connected with the container 12. Again, the first ends 26 are preferably connected with brackets 30 connected to container 12. According to one aspect, one hook 18 is connected to the second ends 28 of both extensions 24. As shown, hook 18 extends between and connects the separate second ends 28 of both extensions 24. FIG. 5 shows the invention lid 14 in a top view of the invention.

By way of further description, the device of the present invention is removable in order to comply with residential restrictions and/or regulations as well as to make it so that the user can keep the invention in case they relocate/move their residence. Accordingly, the apparatus of the present invention locks in place by use of a mechanism that temporarily hooks on the threshold of a door that locks into place once the door is closed.

Applicant has tested the functionality of the box and hook mechanism. Preferably, the box/container has a hinged lid with a combination lock mounted to the top so that the delivery person can unlock the box, place the packages safely inside and then relock the box. The hook mechanism on the back of the box by means of the bracket of the invention preferably provides six inches of space to travel, up and down, in order to accommodate various slab and foundation heights from door to threshold. When the box is put into place outside an open inward swinging door, for example only and not by way of limitation, the hook end of the extension mechanism is dropped down and put in place over the threshold of the open door and once the door is closed it secures the box from being removed.

When the user wants to remove the box and store it until the next time a package is expected and it is needed, the user simply lifts the hook mechanism up and folds it against the back of the box where preferably a magnet is mounted to hold the mechanism in place so that the extension is secure and not swinging while moving the box.

In use, according to one embodiment and for example only and not by limitation, the user of the invention provides their delivery company/personnel with specific information in their delivery instructions on placing the packages in the box/container including their personalized combination to the lock. Such delivery instructions are commonly provided and may include combinations and the like. Otherwise, a receiver portal or opening, as are commonly found on mail boxes, may be provided which allows insertion of items into the box but does not enable removal once inserted.

By way of continued description and details, the hooking mechanism preferably is attached to the back of the box in a preferred embodiment by four drilled holes in which two twelve inch pieces of round stock, three inches of which are bent 90° on each end and threaded one inch. Two pieces of aluminum flat stock (bar) have a hole in the end of each of them one-half inch from the sides and end where the round stock goes through them. Then the round stock is installed into the back of box where the holes have been drilled. Nuts are then placed on the round stock to hold it to the box.

On the end of the aluminum flat stock (bar) extension that goes over the threshold of the inside of the door there are two holes drilled into each piece of aluminum flat stock (bar) one-half inch in from each side. A piece of angle steel has two holes drilled and tapped into the top of each side which is where the aluminum flat stock (bar) has screws going through it and threading into the angle steel with one leg pointing down and the other leg pointing away from the box.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A selectively securable container apparatus comprising:

a. a container with a lid wherein the container is sealed from opening when the lid is in a closed and locked position;

b. a hook with a first size;

c. an extension with a first end and a second end and a length, where the length has a second size and where the second size of the length is smaller than the first size of the hook, where the first end is connected with the container and the second end is connected with the hook and wherein the smaller second size of the length of the extension fits between a space between the bottom of a first object and the top of a second object but the first size of the hook is larger than the space wherein said hook connects with said second object; and d. a bracket connected with the container wherein the first end of the extension is connected with the bracket such that the first end is movable along the bracket such that container location is adjustable along said bracket without moving said extension.

2. The apparatus of claim 1 wherein the first object is a door and the second object is a door jamb.

3. The apparatus of claim 1 wherein there is more than one extension.

4. The apparatus of claim 1 wherein there are two extensions, with the first ends of the two extensions connected with the container, and one hook where the one hook is connected to the second ends of both extensions.

5. The apparatus of claim 1 wherein the hook extends from and perpendicular to the second end of the extension such that the hook engages the second object upon which it rests.

6. The apparatus of claim 1 further including a lock where the lock is removably connectable with the lid and container.

7. The apparatus of claim 1 further including a portal through which items are introduced to the container and wherein the portal blocks items within the container from being removed.

8. The apparatus of claim 1 where the extension is metal flat stock material and the hook is angle steel.

9. A selectively securable container apparatus comprising:

a. a container with a lid wherein the container is sealed from opening when the lid is in a closed and locked position;

b. a hook with a first size; and c. an extension with a first end and a second end and a length, where the length has a second size and where the second size of the length is smaller than the first size of the hook, where the first end is connected with the container and the second end is connected with the hook such that when the length of the extension is placed between a bottom of a door and a door jamb, such that the hook is on one side of the door and the first end of the extension is on the other side of the door when the door is in a closed position with the bottom of the door over the top of the doorjamb, removal of the smaller second size length of the extension is prevented by the larger first size of the hook wherein said hook connects with said door jamb while leaving the door free to open and close.

10. The apparatus of claim 9 further including a bracket connected with the container wherein the first end of the extension is connected with the bracket such that the first end is movable along the bracket such that container location is adjustable along said bracket without moving said extension.

11. The apparatus of claim 9 wherein there is more than one extension.

12. The apparatus of claim 9 wherein there are two extensions, with the first ends of the two extensions connected with the container, and one hook where the one hook is connected to the second ends of both extensions.

13. The apparatus of claim 9 wherein the hook extends from, and perpendicular to, the second end of the extension such that the hook engages the doorjamb.

14. The apparatus of claim 9 further including lock where the lock is removably connectable with the lid and container.

15. The apparatus of claim 9 further including a portal through which items are introduced to the container and wherein the portal blocks items within the container from being removed.

16. The apparatus of claim 9 where the extension is metal flat stock material and the hook is angle steel.

17. A selectively securable container method comprising:

a. providing a container with a lid wherein the container is sealed from opening when the lid is in a closed and locked position; a hook with a first size; an extension with a first end and a second end and a length, where the length has a second size and where the second size of the length is smaller than the first size of the hook, where the first end is connected with the container and the second end is connected with the hook such that when the length of the extension is placed between a bottom of a door and a door jamb, such that the hook is on one side of the door and the first end of the extension is on the other side of the door when the door is in a closed position with the bottom of the door over the top of the door jamb, removal of the smaller second size length of the extension is prevented by the larger first size of the hook wherein said hook connects with said door jamb while leaving the door free to open and close; and b. placing the length of the extension over a door jamb.

18. The method of claim 17 where there is more than one extension.

19. The method of claim 17 wherein there are two extensions, with the first ends of the two extensions connected with the container, and one hook where the one hook is connected to the second ends of both extensions.

* * * * *